United States Patent [19]

Mullendore et al.

[11] Patent Number: 4,749,410

[45] Date of Patent: Jun. 7, 1988

[54] ELONGATED TUNGSTEN HEAVY METAL ARITCLE AND METHOD FOR PRODUCING SAME

[75] Inventors: James A. Mullendore, Towanda; James R. Spencer, Sayre, both of Pa.

[73] Assignee: GTE Products Corporation, Stamford, Conn.

[21] Appl. No.: 17,024

[22] Filed: Feb. 17, 1987

Related U.S. Application Data

[63] Continuation of Ser. No. 753,843, Jul. 10, 1985, abandoned.

[51] Int. Cl.[4] ..... H01H 1/02

[52] U.S. Cl. ..... 75/248; 419/23; 419/28; 419/38; 419/69; 102/501

[58] Field of Search ..... 419/23, 38, 28, 69; 75/248; 102/501

[56] References Cited

U.S. PATENT DOCUMENTS

| | | | |
|---|---|---|---|
| 3,600,924 | 8/1971 | Martin | 72/235 |
| 3,979,209 | 9/1976 | Snyder | 419/39 |
| 3,988,118 | 10/1976 | Grierson et al. | 75/248 |
| 4,090,875 | 5/1978 | Ludwig | 75/248 |
| 4,112,197 | 9/1978 | Metz | 428/629 |
| 4,229,961 | 10/1980 | Vydrin et al. | 72/235 |
| 4,443,249 | 4/1984 | Weber et al. | 148/11.5 P |
| 4,458,599 | 7/1984 | Mullendore et al. | 75/248 |

*Primary Examiner*—Stephen J. Lechert, Jr.
*Attorney, Agent, or Firm*—Donald R. Castle

[57] ABSTRACT

An article of tungsten heavy alloy material is disclosed, the article having essentially elongated tungsten grains, the alloy material comprising tungsten, nickel, and iron, the elongated tungsten grains having a length to diameter ratio of at least about 2 to 1.

A method is disclosed for producing the above article which involves rolling a pressed and sintered body of tungsten heavy alloy material comprising tungsten, iron, and nickel in a tandem rolling mill having a succession of roll stands, each stand consisting essentially of three rolls positioned at about 120° to each other so that the gap between the rolls is a triangle, each stand being rotated about 180° with respect to the adjacent roll stands, the rolling being done at a sufficient temperature to produce the article which has essentially elongated tungsten grains.

6 Claims, 2 Drawing Sheets

ELONGATED TUNGSTEN HEAVY METAL ARITCLE AND METHOD FOR PRODUCING SAME

The invention was made under a contract with the United States Government, Contract No. DAAK 10-84-C-0166.

This application is a continuation of application Ser. No. 753,843, filed 7/10/85, now abandoned.

BACKGROUND OF THE INVENTION

In the as-sintered condition, tungsten heavy alloys have isotropic properties, that is, the properties are equal in all directions, since they consist of nearly spherical tungsten grains in a matrix of the alloying elements as nickel and iron, copper or cobalt. In certain applications as in kinetic energy penetrators, it is desirable to have anisotropic or directional properties to allow for minimum of fracturing and crack propagtion when the penetrator hits a target.

To obtain tungsten heavy metal articles with anisotropic properties, the alloy material must be worked extensively. This is difficult to do with essentially spherical grain tungsten heavy alloys without crack propagation.

Therefore, a method for producing an elongated tungsten grain article of tungsten heavy alloy material without the above disadvantages would be an advancement in the art.

SUMMARY OF THE INVENTION

In accordance with one aspect of this invention, there is provided an article of tungsten heavy alloy material, the article having essentially elongated tungsten grains, the alloy material comprising tungsten, nickel, and iron, the elongated tungsten grains having a length to diameter ratio of at least about 2 to 1.

In accordance with another aspect of this invention, there is provided a method for producing an essentially elongated article of tungsten heavy alloy material, the material comprising tungsten, iron, and nickel. The method involves rolling a pressed and sintered body of the alloy material in a tandem rolling mill having a succession of roll stands, each stand consisting essentially of three rolls positioned at about 120° to each other so that the gap between the rolls is a triangle, each stand being rotated about 180° with respect to the adjacent stands, the rolling being done at a sufficient temperature to produce the article having essentially elongated tungsten grains.

DETAILED DESCRIPTION OF THE INVENTION

For a better understanding of the present invention, together with other and further objects, advantages, and capabilities thereof, reference is made to the following disclosure and appended claims in connection with the above described drawings and description of some of the aspects of the invention.

The article of this invention is made of tungsten heavy alloy material. The alloy material is essentially tungsten, nickel, and iron, Copper and cobalt can also be present. Generally the tungsten is present in from about 70% to about 98% by weight. It is preferred that the alloy material contain no greater than about 96% by weight tungsten and that the nickel and iron be present in a weight ratio of greater than about 1.5 of 1 of nickel to iron. It is especially preferred that the alloy material contain from about 90% to about 96% by weight tungsten and that the nickel and iron be present in a weight ratio of about 7 to 3 of nickel to iron.

The article generally has a tungsten grain diameter of about 20 to 80 microns.

Figure 1:
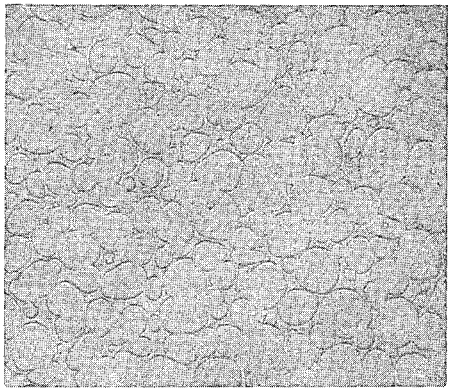
FIG. 1 is a photomicrograph taken at about 200× magnification of essentially spherical grain tungsten heavy alloy material in the as-sintered condition.
Figure 2:
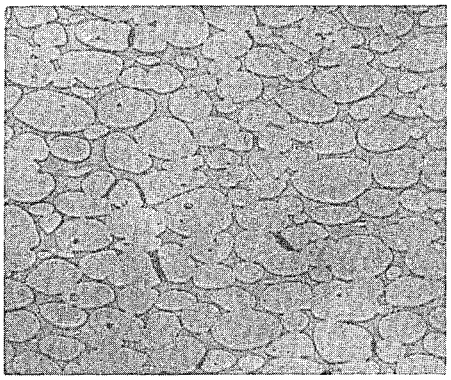
FIG. 2 is a photmicrograph taken at about 200× magnification of essentially spherical grain tungsten heavy alloy material in a slightly worked condition.
Figure 4:
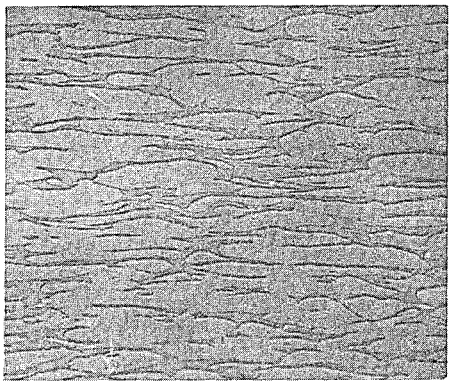
FIG. 4 is a photomicrograph taken at about 200× magnification of the article of this invention.
Figure 3:
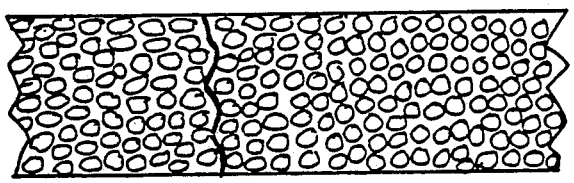
FIG. 3 is a schematic diagram showing the crack propagation pattern in material of FIGS. 1 and 2.
Figure 5:
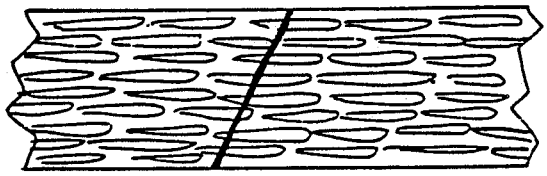
FIG. 5 is a schematic diagram showing where crack propagation would occur in the article of this invention.

The tungsten grains have a length to diameter ratio of at least about 2 to 1, and preferably from about 4 to 1 to about 5 to 1. The advantage of this structure is that it is more resistant to fracturing than the more spherical structure. FIGS. 1 and 2 are photomicrographs of the prior art material. FIG. 1 is a photomicrograph taken at about 200× magnification of essentially spherical grain tungsten heavy alloy material in the as-sintered condition. FIG. 2 is a photomicrograph taken at about 200× magnification of essentially spherical grain tungsten heavy alloy material in a slightly worked condition, that is, worked to about a 30% reduction in diameter, or a length to diameter ratio of about 1.5 to 1. FIG. 2 shows that even with a slight amount of working, there are defects present. FIG. 3 is a schematic diagram showing how crack propagation occurs in spherical grain tungsten heavy alloy material. It can be seen from FIG. 3 that the crack can follow a path around the tungsten particles, so that it is not necessary to fracture the tungsten particles to weaken the article. FIG. 4 is a photomicrograph taken at about 200× magnification of the article of this invention, in which the tungsten grains are essentially elongated. In elongated tungsten grain articles, the crack cannot transverse the structure of the article without passing through the tungsten particles, and therefore a crack is difficult to propagate. FIG. 5 is a schematic diagram showing where crack propagation would occur in such an article. When the article is a kinetic energy penetrator, the penetrator is strengthened as a result of the elongated tungsten grain structure.

The preferred article of this invention is a kinetic energy penetrator. Kinetic energy penetrators must have the strength to resist cracking since high bending stresses which cause cracking are generated when the penetrator hits a target. The target is usually at high obliquity to the path of the penetrator. When the penetrator strikes the target, the penetrator is deflected from its original path and this in effect bends the penetrator and when the length to diameter ratio of the tungsten grains is less than about 2 to 1, the penetrator fractures in a tranverse manner. That fracturing reduces its ability to perforate the target. With the elongated grain structure, that is, a length to diameter ratio of at least about 2 to 1, the penetrator is more able to resist fracturing and, therefore, gives better performance.

The article can be produced by conventional methods such as swaging or hydrostatic extrusion.

In hydrostatic extrusion, a tungsten heavy metal alloy body is surrounded by fluid in the extrusion chamber. The ram comes in contact with the fluid creating pressure which forces the article out of the die.

However, the preferred method of producing the article of this invention is by rolling the tungsten heavy alloy body in a tandem rolling mill. One advantage of this method is that the body can be heavily worked without introducing an excessive number of defects to obtain the critical length to diameter ratio.

In operation, the body which has been previously pressed and sintered and which is of the material described previously is rolled in the tandem rolling mill which has a succession of rolling stands, each stand consisting essentially of three rolls positioned at about 120° to each other so that the gap between the rolls is a triangle, each stand being rotated about 180° with respect to the adjacent roll stands, so that the resulting rolled article has a hexagonal cross section. Each stand is calibrated to give a successive reduction in diameter of the body. The amount of reduction in diameter of the body corresponds to the length to diameter ratio of the tungsten grains in the article. Typically a 2.8 to 1 length to diameter ratio corresponds to about a 50% reduction.

A typical procedure for rolling a tungsten heavy metal alloy body to produce the article of this invention is given in the examples that ensue.

The three point loading of the body during loading creates a stress system which is not as likely to cause fracture as the more common two point loading rolling mills. High rod rolling speeds such as in excess of about 2000 feet per minute can be attained. Tungsten has a very low specific heat and a high thermal conductivity and, therefore, cools very fast. The rolling speed is fast enough so that the cooling rate is balanced by the heat generated by the deformation process and constant or slightly increasing temperature rolling results.

The rolling is done at a sufficient temperature to produce the article,having essentially elongated grains. Temperatures are no greater than about 1000° C. and are preferably from about 650° C. to about 800° C. with about 700° C. being especially preferred. If the temperature rises much above about 900° C., microcracking is noticed. If the temperature is lower than the ranges given, there is too much stress on the rolling mill.

The preferred tandem rolling mill is manufactured by Friedrich Kocks and is sold under the name of Kocks Rolling Mill.

One advantage of tandem roll milling is that the article which is generally a long rod can be cut into many small parts. This is opposed to having to press, sinter, and work each individual part.

In order to insure that the article will resist fracturing, the article can be annealed at from about 600° C. to about 1400° C. depending on the specific properties desired.

To more fully illustrate this invention, the following non-limiting examples are presented.

To roll the tungsten heavy metal alloy body, the following procedure is generally used. First the mill is set up to obtain the amount of rolling required. A typical mill has twelve stand positions. Each stand typically gives a reduction in area of about 18%. The stand calibration is expressed as a plug gauge size. That is, it is the diameter of a body, in particular, a rod that just fits into the gap between the rolls.

EXAMPLE 1

Stands having plug sizes of about 0.480, 0.435, 0.394, and 0.357 inch are put into the first four stand positions. Bars having a diameter of about 0.526, inch are heated to temperatures of about 300° C., 700° C., and 900° C. and fed into the mill. All the bars roll successfully. However, rolling at about 300° C. places a high loading on the mill so that this temperature is not desirable. Rolling at about 900° C. gives a large number of defects in the rolled rod. Those defects are microcracks which form at the tungsten/nickel alloy (matrix) interface. For these reasons rolling at about 700° C. is preferred.

EXAMPLE 2

Three additional stands are added to the above stands having plug gauge sizes of about 0.321, 0.281, and 0.300 inch. The latter stand is a finishing stand which has only a 10% reduction so that a more uniform hexagon is produced. Bars are heated to about 700° C. and fed into the mill and are again rolled successfully. The bars after rolling have a cross sectional area of about 0. 1030 sq. in. giving an overall reduction of about 53%.

EXAMPLE 3

Two additional stands having plug gauge sizes of about 0.586 and about 0.530 inch are added to the front (larger diameter) end of the stand line giving a total of nine stands. Bars having a diameter of about 0.700 inch are rolled using a preheat temperature of about 700° C. A total reduction of about 73% is obtained. Therefore, the above three examples show that by increasing the number of stands, the amount of reduction is increased. The work described above is done at a rolling speed of about 300 RPM.

EXAMPLE 4

With seven stands in place as in Example 2, tests are run at several rolling speeds, that is, RPM's of the driving motors. At a rolling temperature of about 700° C. and an RPM of about 300, the temperature of the bar exiting the mill is about 1000° C. which is too high. The RPM is lowered to about 200, 250, and 150. At about 150 RPM, the bar is noticeably colder than at the higher RPM's and the mill becomes overloaded. It is believed that a rolling speed of about 250 RPM is satisfactory.

While there has been shown and described what are at present considered the preferred embodiments of the invention, it will be obvious to those skilled in the art that various changes and modifications may be made therein without departing from the scope of the invention as defined by the appended claims.

What is claimed is:

1. An article comprising a kinetic energy penetrator of a tungsten heavy alloy containing from about 70% to about 96% by weight of tungsten and nickel and iron in a weight ratio of greater than about 1.5:1 of Ni:Fe, said alloy material having elongated tungsten grains having a length to diameter ratio of at least about 2:1.

2. An article of claim 1 wherein said alloy material comprises from about 90% to about 96% by weight tungsten, and nickel and iron in a weight ratio of about 7 to 3 of nickel to iron.

3. A method for producing an elongated article of tungsten heavy alloy material, said process comprising rolling a pressed and sintered body of said material, consisting essentially of from about 70% to about 96% by weight tungsten, balance nickel and iron in a weight ratio of greater than 1.5:1 of Ni:Fe, in a tandem rolling mill having a succession of roll stands, each stand consisting essentially of three rolls positioned at about 120° to each other so that the gap between the rolls is a triangle, each stand being related about 180° with respect to the adjacent roll stands, said rolling being done at a sufficient temperature to produce said article having essentially elongated tungsten grains having a length to diameter ratio of at least about 2:1.

4. A method of claim 3 wherein said tungsten heavy alloy material comprises from about 90% to about 96% by weight tungsten, and nickel and iron in a weight ratio of about 7 to 3 of Ni to Fe.

5. A method of claim 3 wherein the temperature is no greater than about 1000° C.

6. A method of claim 3 wherein the temperature is from about 650° C. to about 800° C.

* * * * *